US007293377B2

(12) United States Patent
Pinther, II et al.

(10) Patent No.: US 7,293,377 B2
(45) Date of Patent: Nov. 13, 2007

(54) WEAR PAD FOR AN EXTENDABLE LINKAGE

(75) Inventors: George Carl Pinther, II, Raleigh, NC (US); Brian Carter Buchanan, Clayton, NC (US); Jay Holloman Renfrow, Kenly, NC (US); Gary Walth, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 134 days.

(21) Appl. No.: 10/928,267

(22) Filed: Aug. 30, 2004
(Under 37 CFR 1.47)

(65) Prior Publication Data

US 2006/0042131 A1 Mar. 2, 2006

(51) Int. Cl.
*E02F 3/28* (2006.01)

(52) U.S. Cl. ..... 37/443; 37/466; 172/450; 384/42

(58) Field of Classification Search ..... 37/443, 37/466; 172/450; 414/728; 384/42, 35
See application file for complete search history.

(56) References Cited

U.S. PATENT DOCUMENTS

| | | | | | |
|---|---|---|---|---|---|
| 2,719,761 | A | * | 10/1955 | Bonnafe | 384/42 |
| 3,609,930 | A | | 10/1971 | Crandal | |
| 3,620,579 | A | * | 11/1971 | Brown et al. | 384/35 |
| 3,709,304 | A | * | 1/1973 | Haupt | 172/450 |
| 3,748,807 | A | | 7/1973 | Sterner | |
| 3,910,355 | A | * | 10/1975 | Elfes et al. | 172/450 |
| 4,016,688 | A | | 4/1977 | Tiffin et al. | |
| 4,045,936 | A | | 9/1977 | Sterner | |
| 4,111,320 | A | | 9/1978 | Breeding | |
| 4,208,847 | A | | 6/1980 | Gaura et al. | |
| 4,255,076 | A | | 3/1981 | Svenning | |
| 4,257,201 | A | * | 3/1981 | Landolt et al. | 52/118 |
| 4,264,265 | A | | 4/1981 | Stoychoff | |
| 4,268,057 | A | * | 5/1981 | Engelmann et al. | 280/474 |
| 4,337,601 | A | | 7/1982 | Vaerk et al. | |
| 4,470,613 | A | * | 9/1984 | Sykes | 172/450 |
| 4,515,520 | A | | 5/1985 | Parquet et al. | |
| 4,725,187 | A | | 2/1988 | Morelli | |
| 4,759,452 | A | | 7/1988 | Faint et al. | |
| 5,158,189 | A | | 10/1992 | Watson et al. | |
| 5,199,193 | A | * | 4/1993 | Akiba et al. | 37/341 |
| 5,465,854 | A | | 11/1995 | Sturm et al. | |
| 6,428,265 | B1 | | 8/2002 | Gilmore, Jr. | |
| 6,591,918 | B1 | * | 7/2003 | Wojewodzki et al. | 172/450 |
| 6,726,437 | B2 | | 4/2004 | Albright et al. | |

* cited by examiner

*Primary Examiner*—Thomas A Beach
(74) *Attorney, Agent, or Firm*—Finnegan, Henderson, Farabow, Garrett & Dunner

(57) ABSTRACT

A wear pad on a linkage of a work machine is disclosed. The linkage includes a first and a second linkage member in a telescoping relationship. The wear pad includes a first end having a first thickness and a second end having a second thickness, the first thickness being greater than the second thickness. The wear pad also includes a flat wear face configured to slidably interface with the first linkage member. A fixed surface has a bore formed therein. The bore is configured to receive an attachment member to securely attach the wear pad to the second linkage member.

15 Claims, 4 Drawing Sheets

WEAR PAD FOR AN EXTENDABLE LINKAGE

TECHNICAL FIELD

This disclosure relates to a wear pad for an extendable linkage, and more particularly, to a wear pad that is adjustable to reduce play in an extendable linkage.

BACKGROUND

An extendable linkage, such as a telescoping linkage, may be used on a work machine to extend the reach of the work machine, thereby making the work machine usable in a variety of applications. One example of an extendable linkage is an extendable stick (E-stick) on a backhoe loader. An E-stick typically has an outer member and an inner member, which are allowed to slide relative to each other to provide additional reach and digging depth. The amount of extension or slide is typically controlled by a hydraulic cylinder within the E-stick.

Extendable linkages, such as the E-stick, include wear pads disposed between the inner and outer sliding members. The wear pads reduce gaps and play between the members and form low-friction contact points between the members. Over time and use, the thickness of the wear pads decreases because of wear, introducing an increasing amount of play and allowing an increasing amount of movement between the inner and outer members in directions other than a sliding direction. This loose play can reduce an operator's ability to precisely control the location of the work implement.

To reduce the play, wear pads are typically replaced or adjusted when they become worn. Accessing the wear pads on a typical E-stick in order to replace or adjust them typically requires that the inner and outer members be disengaged from each other. Accordingly, disassembly of the entire E-stick is typically necessary to replace or adjust worn wear pads.

Once disassembled, adjustment of the wear pads is often accomplished by placement of shims between the wear pads and the first and second members, compensating for the decreased thickness of the wear pad that occurred by wear. To do this, shims are typically placed on a back surface of the wear pad, moving the front surface of the wear pad in a direction perpendicular to its surface, and closer to the opposing member. Therefore, the front surface of the worn pad is in substantially the same position as the original surface of the pad, reducing the play between the outer and inner members.

U.S. Pat. No. 3,748,807 to Sterner discloses one known wear pad system for an extendable linkage. The '807 patent discloses a telescopic crane boom with trapezoidal-shaped inner and outer boom sections extendable relative to one another. Typical wear pads are disposed below the inner boom section and appear to support the weight of any load. A wedge-shaped lateral guide is connected to a side of the outer boom section, contacts a side of the inner boom section with a sliding face, and separates the sides of the inner and outer boom sections. The guide may be adjusted in a direction perpendicular to the sliding face to guide the inner boom section as it moves relative to the outer boom section.

However, the guide of the '807 patent is not configured to bear loads of the crane. In addition, the guide disclosed in the '807 patent is adjusted perpendicular to its sliding face. This perpendicular adjustment may be difficult when counteracting loads are applied against the pad.

The wear pads disclosed herein are intended to overcome one or more of the disadvantages in the prior art.

SUMMARY OF THE INVENTION

In one exemplary aspect, this disclosure is directed to a wear pad on a linkage of a work machine. The linkage includes a first and a second linkage member in a telescoping relationship. The wear pad includes a first end having a first thickness and a second end having a second thickness, the first thickness being greater than the second thickness. The wear pad also includes a flat wear face configured to slidably interface with the first linkage member. A fixed surface has a bore formed therein. The bore is configured to receive an attachment member to securely attach the wear pad to the second linkage member.

In another exemplary aspect, a mechanical linkage for a work machine is disclosed. The mechanical linkage comprises an inner member and an outer member configured to slidably receive the inner member. A wear pad is disposed between the inner and outer members. The wear pad is attached to one of the inner and outer members and includes a wear face configured to slidably contact the other of the inner and outer members. The position of the wear pad is adjustable along an oblique angle relative to the wear face to alter a distance between the inner and outer members.

In yet another exemplary aspect, a method of adjusting a wear pad on a telescoping mechanical linkage formed of an inner and an outer member is disclosed. The wear pad has a wear face configured to slidably contact one of the inner and outer members. The method includes loosening an attachment member to loosen the wear pad from a first position and adjusting the wear pad in an oblique direction relative to the wear face of the wear pad. The method also includes tightening the attachment member to secure the wear pad in a second position.

DETAILED DESCRIPTION

Reference will now be made in detail to exemplary embodiments that are illustrated in the accompanying drawings. Wherever possible, the same reference numbers will be used throughout the drawings to refer to the same or like parts.

Figure 1:
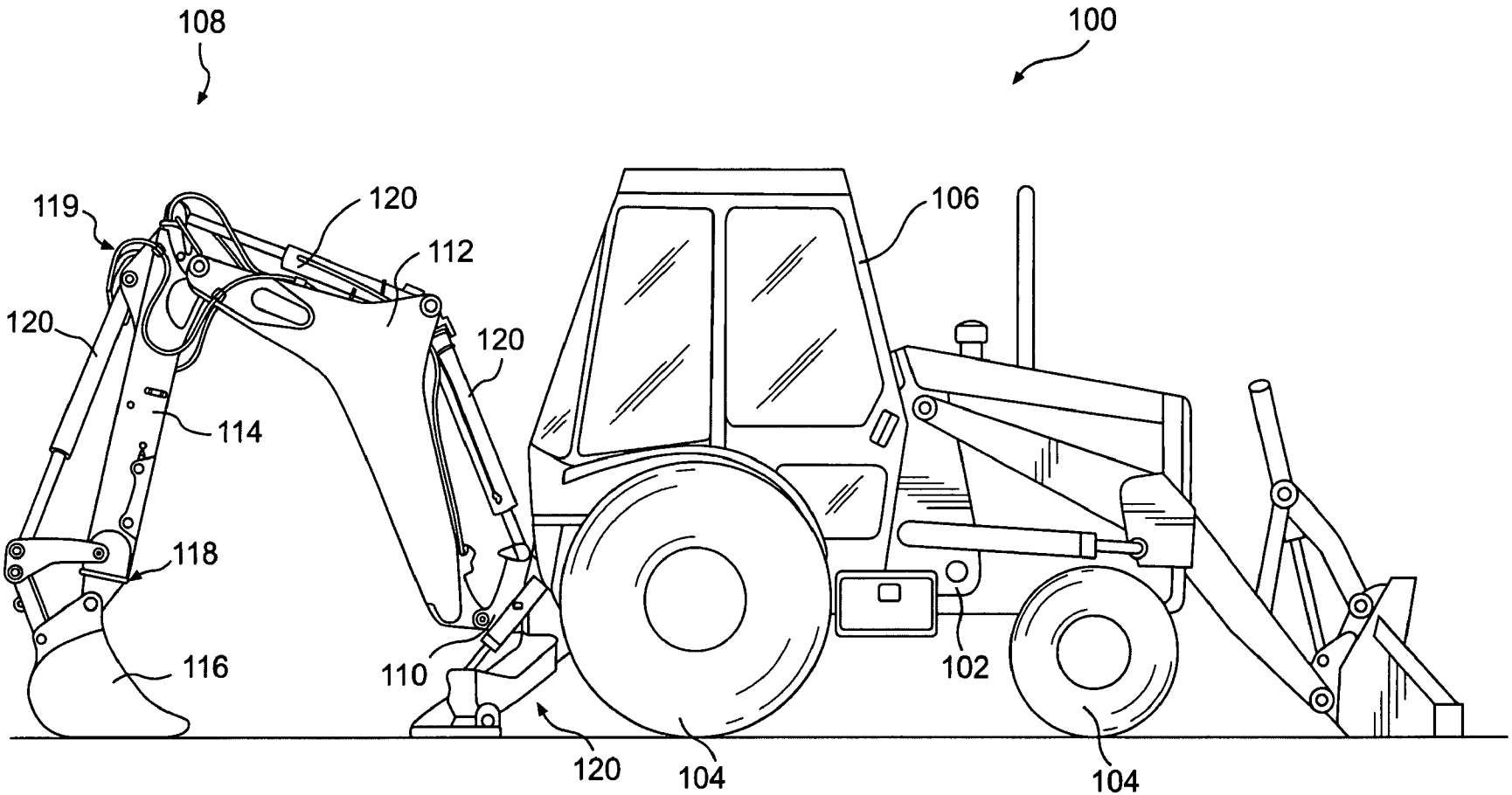
FIG. 1 is a pictorial representation of an exemplary work machine.

FIG. 1 illustrates an exemplary embodiment of a work machine 100. The work machine 100 may be used for a wide variety of applications. Although the work machine 100 is shown as a backhoe loader, it is noted that other types of work machines 100, e.g., telehandlers, extendable cranes, and the like, may be used with embodiments of the disclosed system.

The work machine 100 includes a frame structure 102, wheels 104, an operator's compartment 106, and a mechanical linkage 108. The frame structure 102 supports the operator's compartment 106 and the mechanical linkage 108, and is supported by the wheels 104.

The mechanical linkage 108 may include a number of components, including, for example, as swing frame 110, a boom member 112, an E-stick member 114, and a work implement 116. In the exemplary embodiment of FIG. 1, the E-stick member 114 is an extendible linkage having a work implement end 118 connected to the work implement 116 and a boom end 119 connected to the boom member 112.

Actuators 120 may be connected between each of the components of the mechanical linkage 108. Each of the actuators 120 may be adapted to provide movement between pivotally and/or slidably connected components. The actuators 120 may be, for example, hydraulic cylinders. As is known in the art, the movement of the actuators 120 may be controlled by controlling the rate and direction of fluid flow to the actuators 120.

Figure 2:
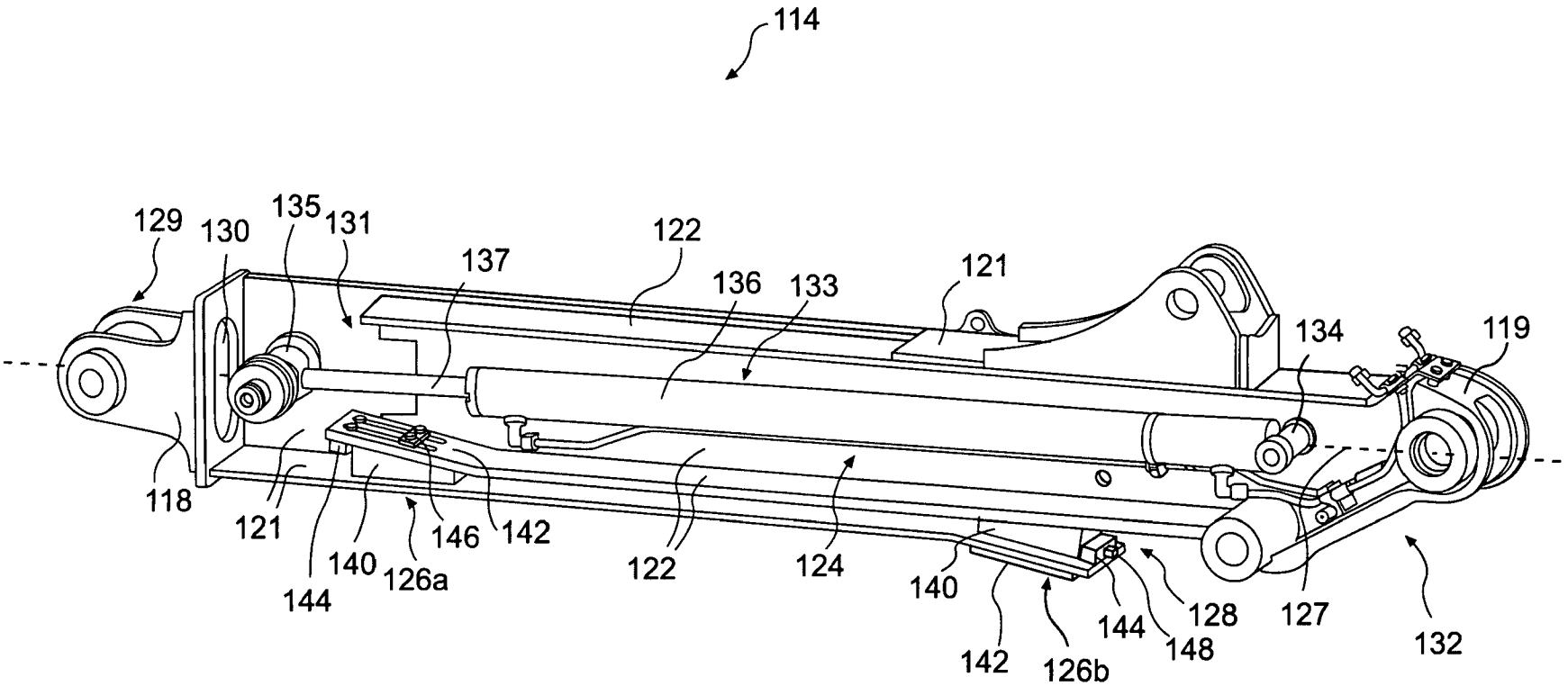
FIG. 2 is a pictorial representation of a cut-away view of an exemplary E-stick from the work machine of FIG. 1.

FIG. 2 shows a cutaway view of the E-stick member 114 in a partially extended position. As shown in FIG. 2, the E-stick member 114 includes an outer member 121, an inner member 122, an actuator assembly 124, and first and second wear pad assemblies, 126*a*, 126*b*, respectively. In the exemplary embodiment shown, the outer and inner members 121, 122 are hollow, rectangular structures extendable relative to each other along a longitudinal axis 127. In the cutaway view, one side and part of the top of the outer member 121 and one side of the inner member 122 are removed for more detailed viewing.

The outer member 121 fits about the inner member 122 and has a receiving end 128 and a connecting end 129. The receiving end 128 is configured to receive the inner member 122, and allows the inner member 122 to extend from the outer member 121 in a telescoping relationship. The connecting end 129 is configured to connect to a component of the linkage 108, and in this embodiment, the connecting end 129 corresponds to the work implement end 118 of the E-stick member 114. Accordingly, in this embodiment, the outer member 121 is configured to connect to the work implement 116 in FIG. 1.

The connecting end 129 includes an access hole 130. The access hole 130 allows a mechanic to access the interior of the E-stick member 114 without disassembly of the E-stick member 114. In one embodiment, a removable panel (not shown) may cover the access hole 130, thereby reducing the opportunity for material, such as soil, rocks, or water, to enter the E-stick member 114 through the access hole 130.

The inner member 122 is configured to slidably fit within the outer member 121 and includes an open end 131 and a connecting end 132. The connecting end 132 is configured to connect to a component of the mechanical linkage 108, and in this embodiment, the connecting end 132 corresponds to the boom end 119 of the E-stick member 114. Accordingly, in this embodiment, the inner member 122 is configured to connect to the boom member 112 in FIG. 1. It should be noted that in other exemplary embodiments, the linkage 108 may include additional extending components. It also should be noted that the position of the E-stick member 114 could be switched so that the outer member 121 is associated with the boom end 119 and the inner member is associated with the work implement end 118.

When the E-stick member 114 is retracted a designated amount to a service position, the open end 131 of the inner member 122 may be accessible through the access hole 130 in the outer member 121. In one exemplary embodiment, the service position is a fully retracted position. In another exemplary embodiment, the service position is a position where the E-stick member 114 is extended to a position about ten to twelve inches from the fully retracted position. When the E-stick member 114 is in the service position, a mechanic may be able to access components, such as, for example, the actuator assembly 124 and at least one wear pad assembly, such as the wear pad assembly 126*a*.

The actuator assembly 124 includes an extension cylinder 133, a first connecting bar 134, and a second connecting bar 135. The first connecting bar 134 is connected to the inner member 122 and the second connecting bar 135 is connected to the outer member 121. The extension cylinder 133 includes a body 136 and a cylinder shaft 137, with the body 136 connected to the first connecting bar 134 and the cylinder shaft 137 connected to the second connecting bar 135. Accordingly, extension of the cylinder shaft 137 from the body 136 extends the outer member 121 relative to the inner member 122, extending the E-stick member 114 in a telescoping manner.

Figure 6:
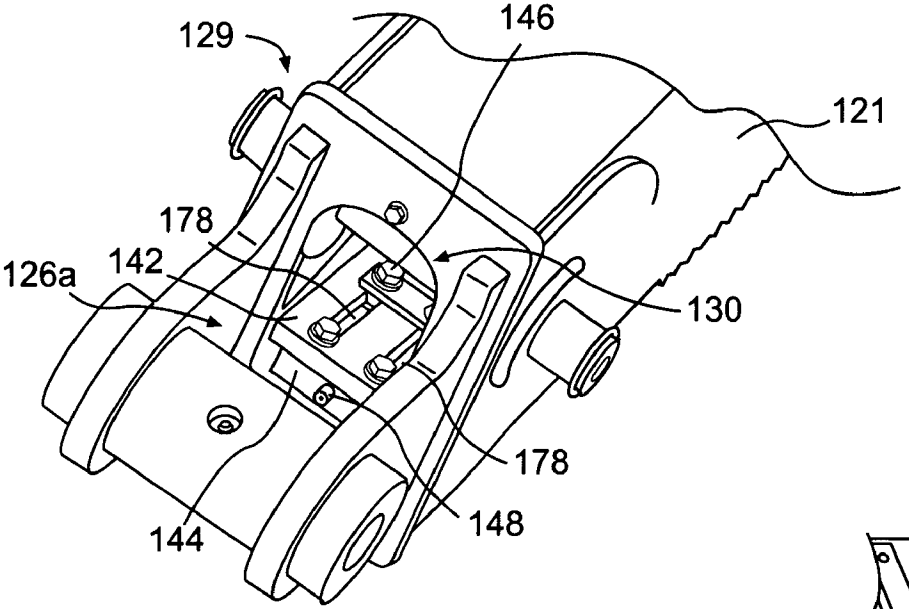
FIG. 6 is a pictorial representation of an outer member of the E-stick of FIG. 2.
Figure 7:
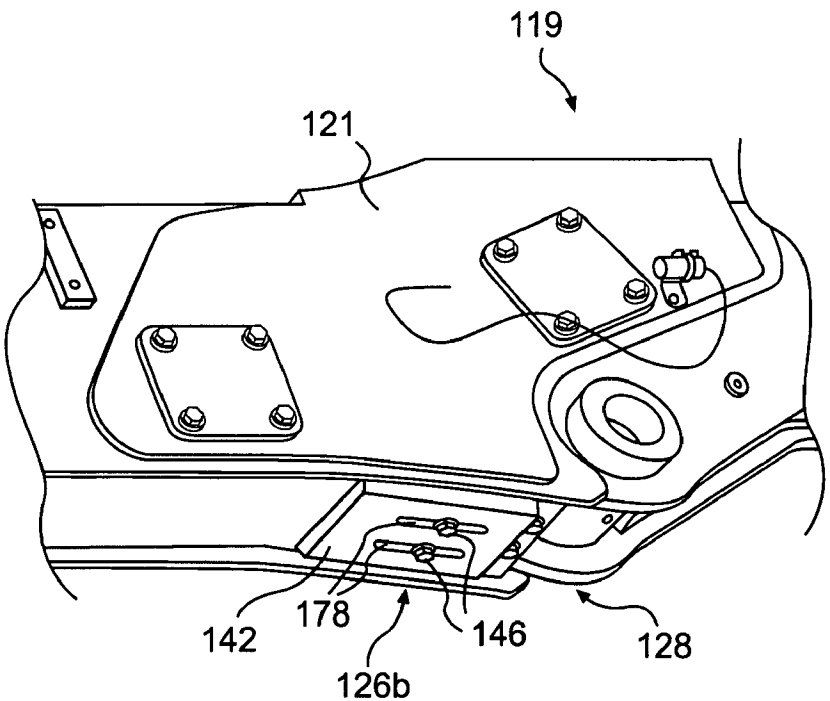
FIG. 7 is a pictorial representation of a receiving end of the outer member of the E-stick of FIG. 2.

The wear pad assemblies 126*a*, 126*b* are shown in FIGS. 2, 6, and 7. The wear pad assemblies 126, 126*b* connect the inner and outer members 121, 122, acting as contact bearings between the members that allow one member to easily move relative to the other. Each wear pad assembly 126*a*, 126*b* includes a wear pad 140, a securing plate 142, a block 144, attachment members, such as securing bolts 146, and an adjustment tool, such as a set screw 148. Other attachment members may include a clamp, a fastener, a link, a joint, a connector, among others. As shown in FIG. 2, the first wear pad assembly 126*a* is connected to and disposed adjacent the open end 131 of the inner member 122, while the second wear pad assembly 126*b* is connected to and disposed adjacent the receiving end 128 of the outer member 121. Both the first and second wear pad assemblies 126*a*, 126*b* are disposed between the bottom of the inner member 122 and the bottom of the outer member 121, thereby bearing loads applied against the mechanical linkage 108. FIG. 6 shows the first wear pad assembly 126*a* through the access hole 130 in the connecting end 129 of the outer member 121. FIG. 7 shows an exterior of the second wear pad assembly 126*b* adjacent the receiving end 128 of the outer member 121.

Figure 5:
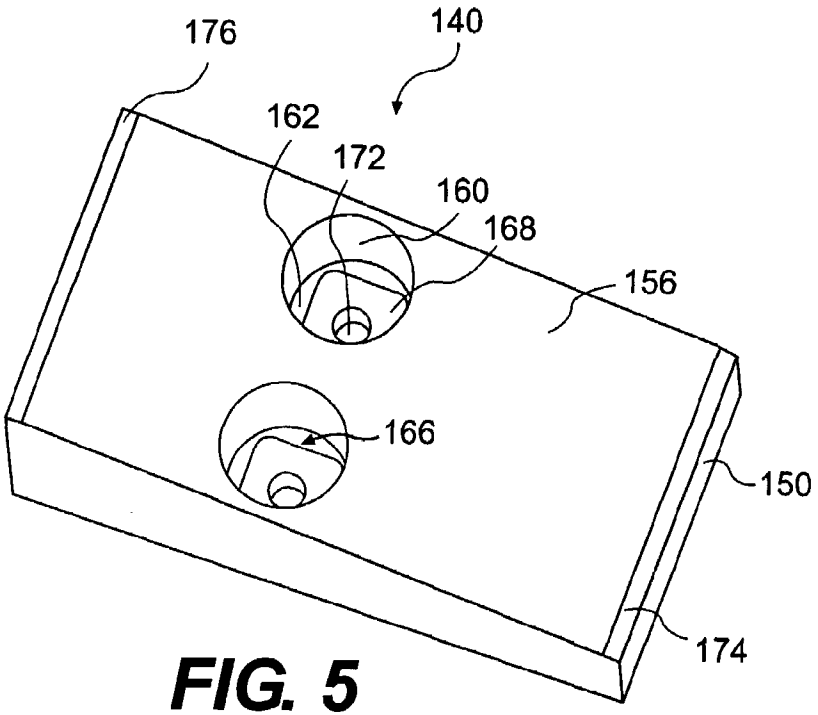
FIG. 5 is a pictorial representation of a perspective view showing a wear face of the wear pad of FIG. 3.
Figure 3:
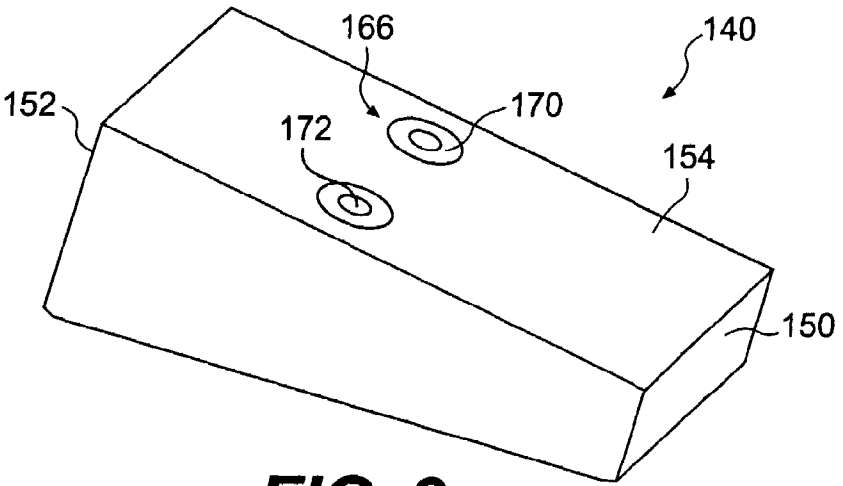
FIG. 3 is a pictorial representation of a perspective view showing a fixed surface of an exemplary wear pad used on the E-stick of FIG. 2.
Figure 4:
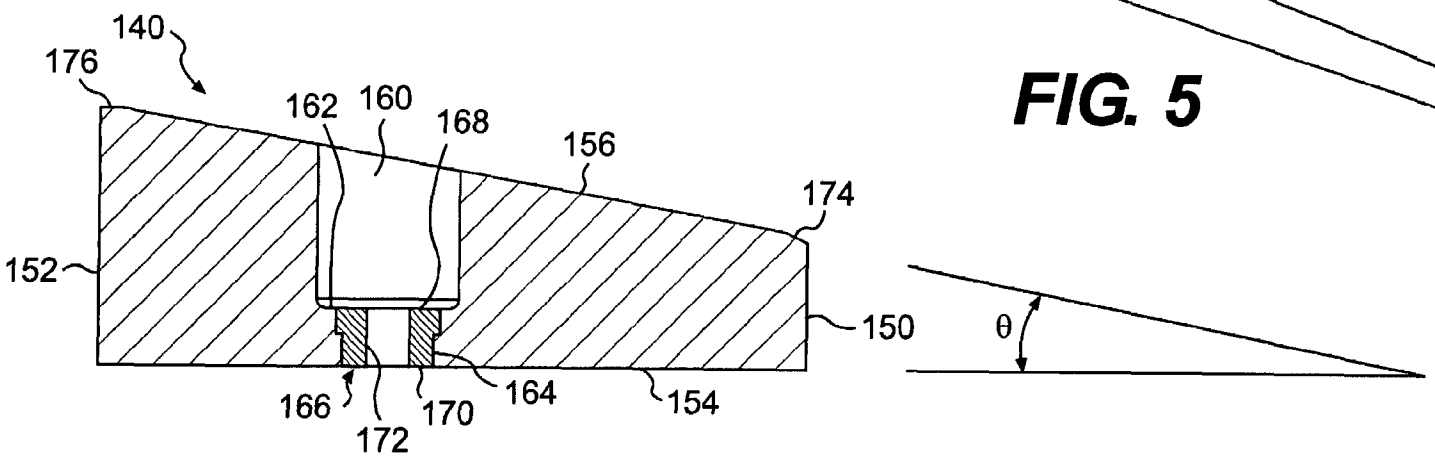
FIG. 4 is a pictorial representation of a cross-sectional view of the wear pad of FIG. 3.

The wear pad 140 is disposed between and in contact with both the inner and outer members 121, 122. It may operate as a low-friction bearing, allowing one member of the inner and outer members 121, 122 to slide along the wear pad 140, while it is fixed to the other. The wear pad 140 will be described with reference to FIGS. 3-5. FIG. 3 shows a perspective of a fixed surface of the wear pad 140 and FIG. 4 shows a cross-sectional view of the wear pad 140. FIG. 5 shows the wear pad 140 flipped over to show a wear face. The wear pad 140 may be a wedge-shaped member having a first end 150, a second end 152, a fixed surface 154, and a wear face 156. The wear pad 140 may also include a bore 160.

The first end 150 of the wear pad 140 may have a thickness less than the second end 152, forming the wedge-shape. Accordingly, the fixed surface 154 and the wear face 156 may form an angle θ relative to each other. In one exemplary embodiment, the angle θ is within the range of 5 and 45 degrees. In another exemplary embodiment, the angle θ is within the range of 5 and 20 degrees. The fixed surface 154 may be a surface configured to contact and be secured to the inner or outer member 121, 122, while the wear face 156 may be a surface configured to slidably contact the opposing member. A width of the wear pad 140 may be substantially the same as the width of the inner member 122. As seen in FIGS. 3-5, the second end 152 may form a right angle with the fixed surface 154.

First and second chamfers 174, 176 may be formed on the first and second ends 150, 152 of the wear face 156, respectively. These first and second chamfers 174, 176 may aid in sliding by providing a rounded leading edge when the outer member 121 moves relative to the inner member 122.

A pad bore 160 may extend into the wear pad 140 from the fixed surface 154 to the wear face 156. The pad bore 160 may include a bottom 162 forming a recess and may include a through hole 164, extending from the bottom 162 to the fixed surface 154. An insert 166 may be disposed within the through hole 164 of the pad bore 160 and may include a square end 168, best seen in FIG. 5, a round end 170, best seen in FIG. 3, and an insert bore 172. The round end 170 of the insert 166 may be substantially flush to the fixed surface 154, while the square end 168 of the insert 166 may be formed such that it will not fit through the through hole 164, and may be substantially flush with the bottom 162. The insert bore 172 may include threads configured to thread onto the securing bolts 146 described below.

In this exemplary embodiment, the wear pad 140 includes two bores 160. However, any number of bores may be formed within the wear pad 140 to allow the wear pad 140 to be secured to the inner member 122 and/or the outer member 120.

The wear pad 140 may be formed of a number of different materials, such as a polymer material, metal material, or any low friction material allowing the inner member 122 of the E-stick member 114 to slide relative to the outer member 121. In one exemplary embodiment, the wear pad 140 is formed of a nylon material.

Returning to FIGS. 2, 6, and 7, the securing plate 142 may be formed integral with or may be connected to the outer and/or the inner member 121, 122. For example, as shown in FIG. 2, the securing plate 142 associated with the wear pad assembly 126*a* is formed integral with the inner member 122. Accordingly, the securing plate 142 may be a part of the inner member 122 itself. In contrast, the wear pad assembly 126*b*, shown in FIGS. 2 and 7, includes a securing plate 142 not integral with, but fixedly connected to the outer member 121. The securing plate 142 may include one or more slots 178, best seen in FIGS. 6 and 7. The slots 178 may be longitudinal slots, generally extending in the direction between the work implement end 118 and the boom end 119. In another exemplary embodiment, the slots extend transverse to the longitudinal direction.

As best seen in FIG. 2, the fixed surface 154 of the wear pad 140 may be adjustably fixed in place on the securing plate 142. To do this, the securing bolts 146 may extend through the slots 178 and into the insert 166 of the wear pad 140. Accordingly, by tightening the securing bolts 146, the insert 166 may urge the fixed surface 154 of the wear pad 140 against the securing plate 142. As shown in FIG. 2, the securing bolts 146 for the first wear pad assembly are disposed within the inner member 122, while the securing bolts 146 for the second wear pad assembly are disposed outside the outer member 121.

As best seen in FIG. 2, the securing plate 142 is disposed at an oblique angle relative to the longitudinal axis 127 of the E-stick member 114. The oblique angle may be substantially the same angle as the angle θ formed between the fixed surface 154 and the wear face 156 of the wear pad 140, shown in FIG. 4. Accordingly, when the fixed surface 154 of the wear pad 140 is against the securing plate 142, the wear face 156 may be substantially parallel to the longitudinal axis 127, and may be configured to lie substantially flat against the opposing inner or outer member 121, 122.

The block 144 may be a rigid structure secured to the securing plate 142 with securing bolts 146 through the slots 178 and/or by other methods. In one exemplary embodiment, the block 146 is formed integral with, or fixedly connected, such as by welding, to the securing plate 142. In another exemplary embodiment, the block 144 is attached securing plate 142 by securing bolts 146 extending through holes formed in the securing plate 142 adjacent the slots 148.

An adjustment tool, such as the set screw 148, may extend through a threaded hole in the block 144 in the direction of the wear pad 140. The set screw 148 may have one end in contact with the wear pad 140, in a manner that as the set screw is rotated within the block, it advances forward, applying an urging force against the second end 152 wear pad 140 to urge the wear pad 140 in a direction along the securing plate 142.

As the wear pad 140 is urged along the oblique angle of the securing plate 142, the wear pad 140 advances in an oblique direction relative to the wear face 156 of the wear pad 140. Thus, the wear pad 140 may move at an oblique angle relative to the longitudinal axis and the wear face 156. Accordingly, the wear pad assembly is configured to move the wear pad 140 obliquely to alter the distance between the wear face 156 and the longitudinal axis 127.

INDUSTRIAL APPLICABILITY

The wear pad assembly and the E-stick member configuration disclosed herein allow maintenance and adjustment of the wear pads 140 to be performed without disassembly of the complete E-stick member 114. Where a typical E-stick member must be disassembled in order to adjust the wear pads to reduce play, the wear pads 140 on the E-stick member 114 may be adjusted without disassembly of the E-stick. This reduces the time of maintenance, thereby increasing available operating time. Further, because a mechanic may access the wear pads 140 without disassembly of the E-stick member 114, a mechanic may adjust the wear pads 140 more frequently, thereby reducing play between the inner and outer members 121, 122, and maintaining a level of precise controllability of the work implement.

To adjust the wear pad 140 on the first wear pad assembly 126*a*, a mechanic may retract the E-stick member 114 to the service position. In one embodiment, the service position is a fully retracted position, so that the inner member 122 is fully enclosed within the outer member 121. In another exemplary embodiment, the service position is a position where the E-stick is extended about ten to twelve inches from the fully retracted position. A panel (not shown) may be removed from the connecting end 129 of the outer member 121, uncovering the access hole 130. Through the access hole 130, and through the open end 131 of the inner member 122, the mechanic may loosen the securing bolts 146, thereby loosening the attachment between the wear pad 140 and the securing plate 142. By turning the set screw 148 in the block 144, the mechanic may advance the wear pad 140 along the securing plate 142. Because the fixed surface of the wear pad 140 and the securing plate 142 have an inclined surface, the wear pad 140 moves obliquely relative to the longitudinal axis 127 of the E-stick member 114 and obliquely relative to the wear face 156 of the wear pad 140. Also because of the angle, as the wear pad 140 advances, the wear face 156 moves toward the opposing member, reducing the play between the outer and inner members 121, 122.

To adjust the wear pad 140 of the second wear pad assembly 126*b*, the mechanic has access to the securing bolts 146 and the set screw from the exterior of the outer member 121. Accordingly, the mechanic can loosen the securing bolts 146, adjust the wear pad 140 with the set screw 148, and tighten the securing bolts 146, as described above.

Although each wear pad 140 is disposed between the bottom of the inner member 122 and the bottom of the outer member 121, adjustment of the wear pad 140 reduces or eliminates play between both the bottoms and the tops of the inner and outer members 121, 122. This is because adjustment of the wear pad 140 raises the inner member 122 relative to the outer member 120, compensating for play in both an upward and downward direction. The oblique movement of the wear pad 140, thereby alters the distance between the inner and outer members 121, 122.

When the wear pad 140 has been adjusted to a proper position reducing the play between the inner and outer members 121, 122, the securing bolts 146 may be retightened, thereby securing the wear pad 140 in place on the securing plate 142. In this manner, the wear pads 140 may be adjusted without removing the outer member 120 from the inner member 122. In the event that a mechanic wishes to change the wear pad 140, he may completely remove the securing bolts 146 and the block 144. In so doing, he will release the pad 140 from the securing plate 142, and it may be removed and replaced.

Although the wear pad assembly described herein is described with reference to a backhoe loader 100, the wear pad assembly may be used on any work machine having a telescoping linkage, such as a material handler and/or a crane, among others.

It will be apparent to those skilled in the art that various modifications and variations can be made in the disclosed embodiments without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A mechanical linkage for a work machine, comprising:

an outer member;

an inner member slidably moveable within at least a portion of the outer member; and a wear pad disposed between the inner and outer members, the wear pad being attached to one of the inner and outer members and having a wear face configured to slidably contact the other of the inner and outer members, the position of the wear pad being adjustable along an oblique angle relative to the wear face to alter a distance between the inner and outer members.

2. The mechanical linkage of claim 1, wherein the wear pad is at least partially disposed in a position that is one of below the inner member and above the inner member.

3. The mechanical linkage of claim 1, wherein the wear pad is wedge shaped.

4. The mechanical linkage of claim 1, including a securing plate configured to directly attach to the wear pad, the securing plate being disposed at the oblique angle, the wear pad being adjustable along the securing plate.

5. The mechanical linkage of claim 1, including:

an adjustment tool configured to urge the wear pad along the oblique angle;

an attachment member configured to selectively secure the wear pad in a fixed position; and a securing plate having at least one slot formed therein, the attachment member extending through the at least one slot into the wear pad.

6. The mechanical linkage of claim 1, including an adjustment tool adjacent the wear pad and configured to advance the wear pad to adjust the position of the wear pad in the oblique direction.

7. The mechanical linkage of claim 1, wherein the wear pad is connected to the outer member, and is adjustable along the oblique angle from the exterior of the outer member.

8. The mechanical linkage of claim 1, wherein the wear pad is connected to the inner member, and is adjustable by an attachment member associated with the inner member.

9. The mechanical linkage of claim 8, wherein the outer member includes an access hole, the wear pad being disposed to be adjustable through the access hole.

10. The mechanical linkage of claim 1, wherein the wear pad is a first wear pad disposed adjacent a receiving end of the outer member, the mechanical linkage including a second wear pad disposed adjacent a connection end of the outer member.

11. The mechanical linkage of claim 1, including a boom member directly connected to the inner member; and a work implement directly connected to the outer member, wherein the inner and outer members form a telescoping e-stick.

12. A work machine comprising:

a frame;

a telescoping mechanical linkage operatively connected to the frame, including an inner member, an outer member configured to slidably receive the inner member, a first wear pad disposed below the inner member and between the inner and outer members, the first wear pad being attached to the inner member and having a wear face configured to slidably contact the outer member, and a second wear pad disposed below the inner member and between the inner and outer members, the second wear pad being attached to the outer member and having a wear face configured to slidably contact the inner member, wherein a position of each of the first and second wear pads is adjustable along an oblique angle relative to the respective wear face to alter a distance between the inner and outer members; and a work implement operatively connected to the mechanical linkage.

13. The work machine of claim 12, including a first and a second securing plate configured to directly attach to the first and second wear pads, respectively, the first and second securing plates being disposed at the respective oblique angles, the first and second wear pads being adjustable along the first and second securing plates.

14. The work machine of claim 12, wherein the mechanical linkage includes:

a first and second adjustment tool adjacent the first and second wear pads, respectively, and configured to advance the respective first and second wear pads to adjust the position of the first and second wear pads in the oblique direction;

first and second attachment members configured to selectively secure the first and second wear pads, respectively, in a fixed position; and first and second securing plates having at least one slot formed therein, the first and second attachment members respectively extending through the at least one slot into the respective first and second wear pads.

15. The work machine of claim 12, wherein the outer member includes an access hole, the first wear pad being disposed to be adjustable through the access hole.

* * * * *